United States Patent [19]

Crossett

[11] Patent Number: 4,612,677

[45] Date of Patent: Sep. 23, 1986

[54] CONVERTIBLE SOFA MECHANISM

[76] Inventor: Edward H. Crossett, P.O. Box 10152, Costa Mesa, Calif. 92627

[21] Appl. No.: 773,982

[22] Filed: Sep. 9, 1985

[51] Int. Cl.[4] ..... A47C 17/14

[52] U.S. Cl. ..... 5/12 R; 5/13; 5/35; 5/51 E; 5/18 B; 297/DIG. 3

[58] Field of Search ..... 5/12 R, 13, 18 B, 18 R, 5/17, 24, 47, 63, 66, 51 E, 51 C, 35, 36; 297/DIG. 3, DIG. 8

[56] References Cited

U.S. PATENT DOCUMENTS

| | | | |
|---|---|---|---|
| 327,605 | 10/1885 | Shaw | 5/18 B |
| 2,770,814 | 11/1956 | Schindler | 5/13 |
| 2,947,006 | 8/1960 | Coopersmith | 5/13 |
| 3,064,276 | 11/1962 | Newsom | 5/17 |
| 3,458,877 | 8/1969 | Edwards | 5/13 X |
| 3,792,501 | 2/1974 | Kery | 5/12 R |
| 4,067,073 | 1/1978 | Komarov | 5/18 R |
| 4,074,371 | 2/1978 | Lindbloom | 5/18 R |
| 4,538,854 | 9/1985 | Wilson | 279/DIG. 3 |

FOREIGN PATENT DOCUMENTS

| | | | |
|---|---|---|---|
| 2844628 | 4/1980 | Fed. Rep. of Germany | 297/DIG. 8 |

*Primary Examiner*—William F. Pate, III
*Assistant Examiner*—Richard E. Chilcot, Jr.
*Attorney, Agent, or Firm*—Edgar W. Averill, Jr.

[57] ABSTRACT

An improved three-section convertible sofa mechanism for installation in a convertible sofa. The mechanism has three sections which unfold from a sofa configuration into a bed configuration. The conversion is assisted by a motor-operated pair of bellows which assist in the lifting and positioning of the mechanism during the unfolding operation. The front edge of the convertible sofa and of the bed both deflect downwardly to eliminate the usual uncomfortable forward edge of such convertible sofas.

14 Claims, 14 Drawing Figures

10
12
15
17
14
16
70
11
13
20
18
2
1

70
5
51
52
47
70
11
104
5
22
36
49
50
53
54
35
40
37
105
19
38
31
110
106
108
107
44
46
28
21
20
41
30
21
25
26
61
48
62
39
32
21
111
27
21
39
24
21
23
10
18

CONVERTIBLE SOFA MECHANISM

BACKGROUND OF THE INVENTION

The field of the invention is convertible sofas and the invention relates more particularly to convertible sofa mechanisms which unfold in three sections from the sofa seat portion.

Most commonly used convertible sofas utilize a foldable mattress which is maintained within the convertible sofa when the bed is folded into its couch configuration. Then when the mechanism is unfolded for use as a bed, the mattress is maintained on the upper surface. Unfortunately, such mattresses, since they need to be folded, must be thin and such convertible sofas are, thus, inherently uncomfortable and are only satisfactory for small children or for emergency use. Also, the forward edge of such convertible sofas, both in the folded sofa configuration or the extended bed configuration, have a hard forward edge which makes it uncomfortable to sit on the forward edge of the convertible sofa or the bed.

SUMMARY OF THE INVENTION

It is an object of the present invention to provide an improved three-section convertible sofa mechanism which converts into a bed having a mattress of full thickness and which eliminates the uncomfortable forward edge of the convertible sofa, both in the sofa configuration and in the bed configuration.

The present invention is for an improved three-section convertible sofa mechanism for installation in a convertible sofa which may be forwardly extended to a full length bed which has a head section, a middle section and a foot section. The improvement comprises a base member supported on the floor, said member having a right side, left side, front edge and a back edge and having an upwardly extending support along its front edge. First and second inverted "J-shaped" channels are held along the right and left sides of the base member, respectively, and oriented so that the terminus of the "J" faces the front edge of the base. First and second main bellows members are held by the base and are adjacent to first and second inverted "J-shaped" channels. Each of the main bellows has a straight sidewardly-facing channel on its upper surface. A head section is held by the base above and generally parallel thereto, said head section having a right side, left side, front edge and a back edge. Right and left cam follower means are affixed to the right and left edges of the head section, each of the cam follower means being captured both by the inverted "J-shaped" channel and by one of the straight, sidewardly-facing channels on the upper surface of each of the bellows. Thus, when the main bellows is inflated, the cam follower means and their associated head section are carried outwardly along said straight, sidewardly-facing channels and upwardly, outwardly and downwardly along said "J-shaped" channels an extent sufficient to cause the head section to rest near its front edge on the upwardly extending support on the base member. A middle section, having a right side, a left side, a front edge and a back edge is hingedly affixed at its back edge to the front edge of the head section, and in its folded condition is supported in a parallel manner above the head section, said middle section having leg means affixed along the right and left edges at the back edge thereof. A foot section has a right side, a left side, front edge and a back edge and the foot section is hingedly affixed at its back edge to the front edge of the middle section and has leg means affixed along the right and left edges thereof at the front edge of the middle section. The foot section is moveable between a folded configuration where one end is parallel to and above the middle section and to an extended configuration when it is in line with the middle section. A preferred configuration of the convertible sofa has its outermost legs comprising a subframe which contains a pair of pivotable polygonal members, each member being moveable between a folded position and an extended position. Each polygonal member has in its folded position a flat base edge resting on the base member, an angled, inwardly and downwardly-facing edge, an angled, inwardly and upwardly-facing edge, an upwardly-facing slot having an inward edge and an outward edge. A pivot hole is positioned in the polygonal member near the outward edge of the slot. The polygonal member also has an angled, outward and upwardly-facing edge and an angled, outwardly and downwardly-facing edge. A pivot pin is affixed to the subframe which is affixed to the right and left edges of the foot section along the front edge thereof. The pivot pin fits in the pivot hole of the polygonal member. A support arm is affixed to the front edge of the foot section and positioned and shaped so that its lower end fits into the slot of the polygonal member and has a length about several inches above the lower end of the slot when no additional weight is exerted on the front edge of the foot section. Biasing means are held between the subframe and the front edge of the foot section. Each of the polygonal members is positioned adjacent the right and left edges of the subframe so that when the subframe is lifted, the polygonal member pivots downwardly so that its angled, outwardly and downwardly-facing edge rests on the adjacent edge of the subframe and the angled, inwardly and downwardly facing side rests on the floor, and the lower end of the support arm is moveable between a first position about several inches above the outward edge of the slot when no additional weight is exerted on the front edge of the foot section and the second position when it is in contact with the outward edge when additional weight is exerted on the front edge of the foot section. In this manner, the front end of the foot section has a biased movement when weight is exerted on it and no uncomfortable forward edge is present.

DESCRIPTION OF THE PREFERRED EMBODIMENTS

Figure 1:
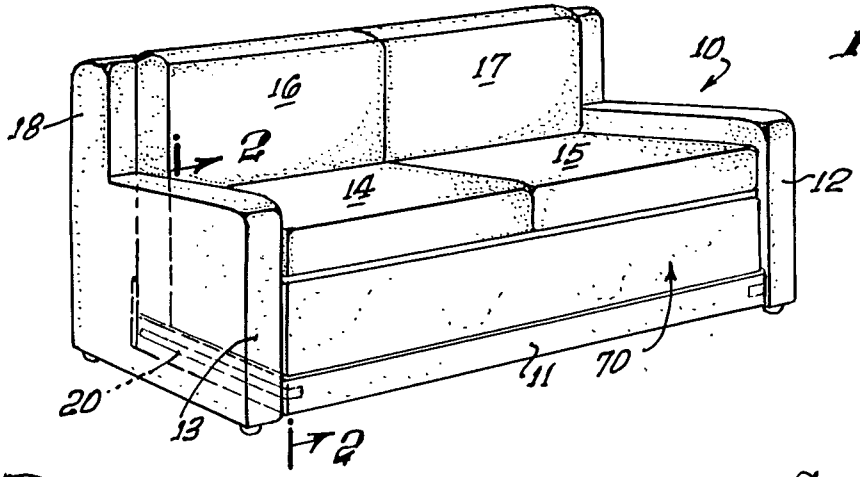
FIG. 1 is a perspective view of the convertible sofa of the present invention in its sofa configuration.

A convertible sofa 10 is shown in perspective view in FIG. 1 and has a front apron 11, a left arm 12, and a right arm 13. A pair of seat cushions 14 and 15 rest on the bed of couch 10, and a pair of back cushions 16 and 17 are supported along the back rest 18 of the couch.

Figure 2:
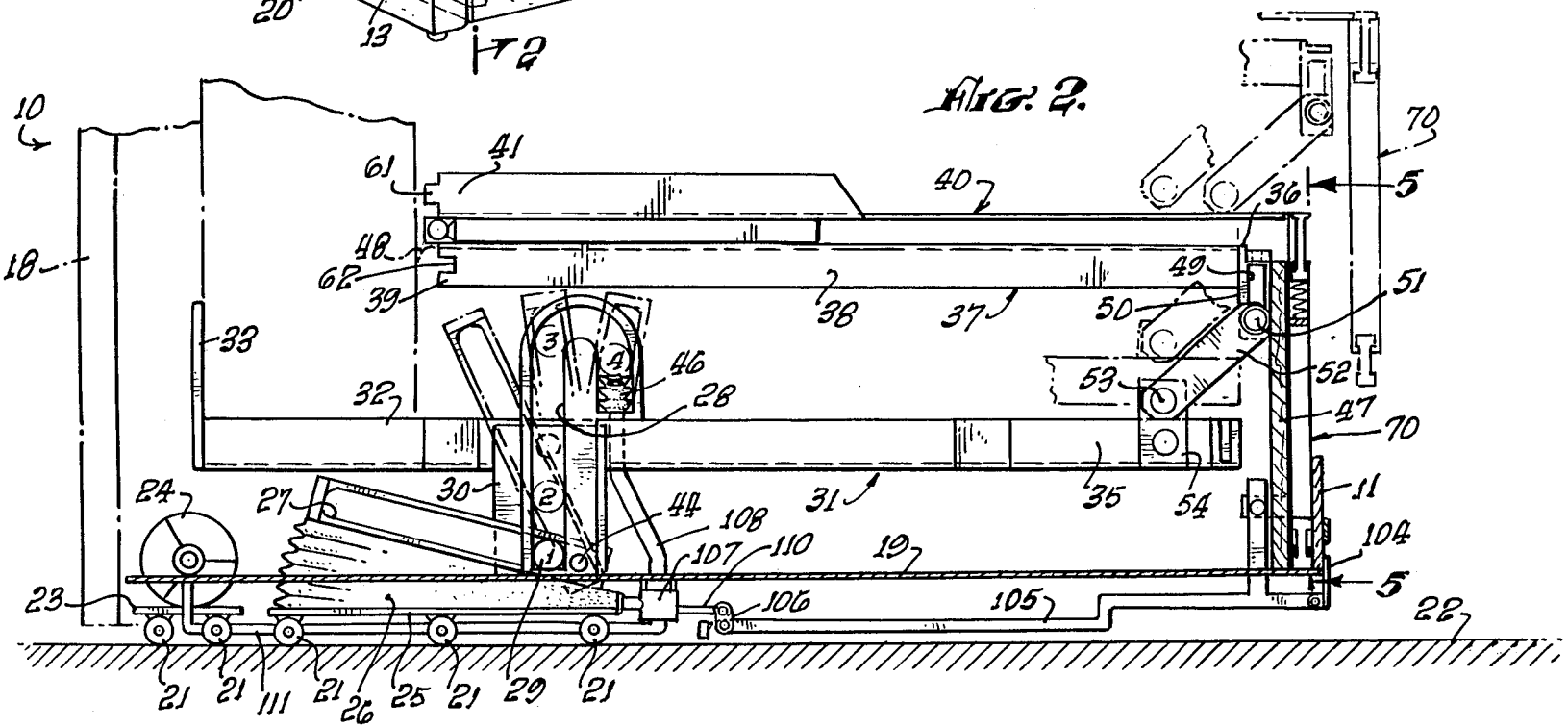
FIG. 2 is an enlarged cross-sectional view taken along line 2—2 of FIG. 1.

The novel mechanism of the present invention which is convertible from the sofa configuration, as shown from the exterior in FIG. 1, is shown in a right side view in FIG. 2. The mechanism is strapped to the couch member which consists of the arms and back, and the mechanism rests on a base member 19 which is not only supported by strap 20 but also by a plurality of wheels 21 which rest on floor 22 and facilitate moving the convertible sofa mechanism into the sofa. Wheels 21 support a bellows motor carriage 23 which supports bellows motor 24. Wheels 21 also support a bellows carriage 25 upon which bellows 26 rest. A straight, sidewardly-facing channel 27 is affixed to the top surface of the bellows and causes a cam follower to ride upwardly along an inverted "J-shaped" channel 28 as described more particularly below. Bellows 26 preferably is wider at the rear thereof to increase the area of the bellows and thereby increase the lifting force. This shape is shown in FIG. 4.

Figure 3:
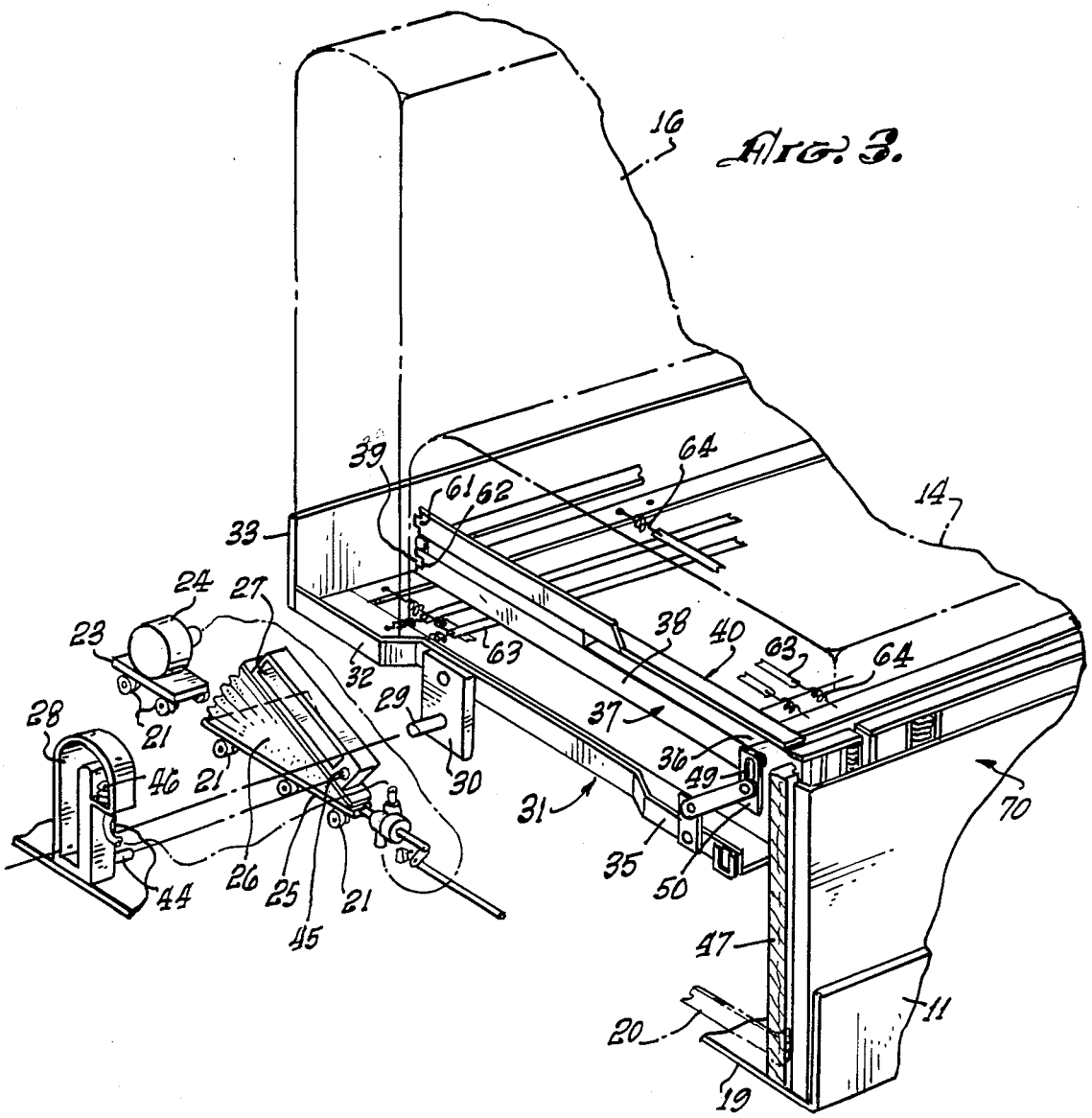
FIG. 3 is an enlarged perspective view of the right and forward edge of the mechanism of the present invention.

The manner in which bellows 26 causes the mechanism to be moved upwardly and outwardly is indicated best in FIG. 3 where the inverted "J-shaped" channel 28 captures a cam follower 29 which also passes through the straight, sidewardly-facing channel 27. Cam follower 29 is held by a plate 30 which is riveted, or otherwise affixed, to frame 31 of the head section of the convertible sofa mechanism. The right side of frame 31 is shown in FIG. 3 and indicated by reference character 32. A head board 33 is supported by frame 31 at the back edge 34 thereof. Frame 31 is hingedly connected at its right and left sides near the front edge 35 to the back edge 36 of the middle section 37. Middle section 37 has a right edge 38 and a front edge 39. Middle section 37 is hingedly affixed to foot section 40 at its rear 41. The front of foot section 40 is indicated by reference character 42 and its right side is indicated by reference character 43.

Figure 4:
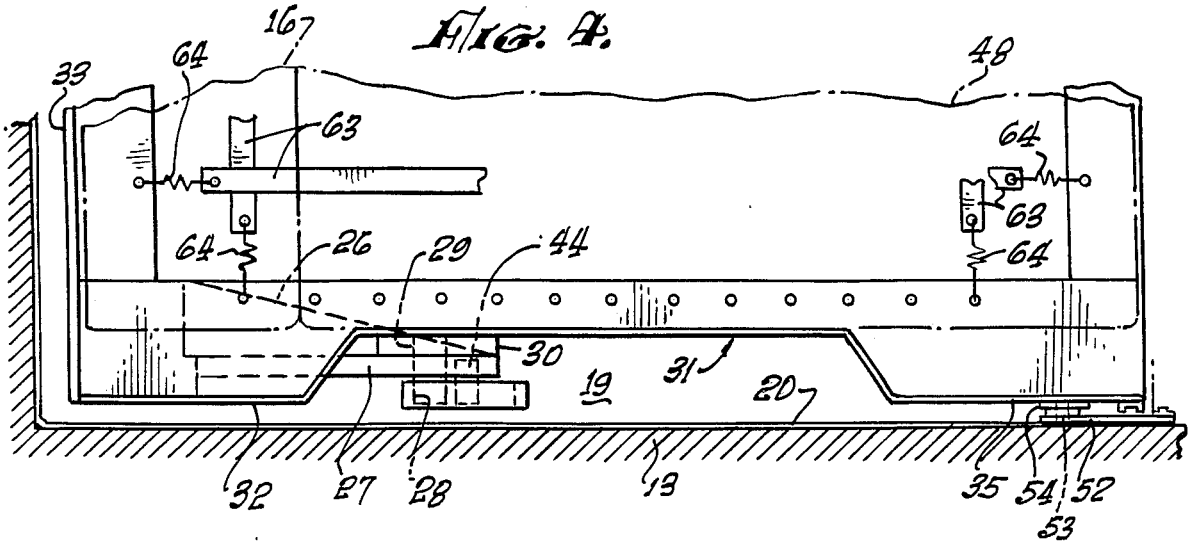
FIG. 4 is an enlarged plan view of the right edge of the mechanism of the present invention.

In assembled form, the right side of the mechanism is shown in plan view in FIG. 4. There it can be seen that cam follower 29 fits in the channel of inverted "J-shaped" channel 28 and also passes through straight channel 27 on the top of bellows 26. It also may be seen in FIG. 3 that the inverted "J-shaped" channel 28 also supports a pivot pin 44 which passes through a hole 45 at the lower end of straight channel 27.

Figure 13:
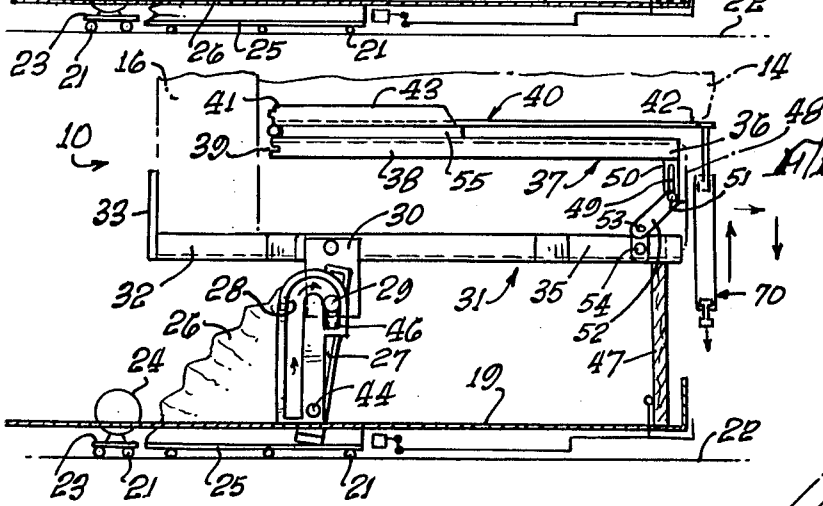
FIG. 13 is a right side view of the convertible sofa mechanism of the present invention as it is being unfolded to a bed configuration.

Thus, returning to FIG. 2, it can be readily seen that as bellows 26 are being filled with air, cam follower 29 moves upwardly in the inverted "J-shaped" channel 28. Four positions are indicated in FIG. 2, and the lowermost position is indicated by reference character "1." As the bellows is raised to position 2, the inner middle and foot sections are all raised upwardly, and as the cam follower reaches position 3, and has almost reached its upwardmost position, and as it moves from position 3 to position 4, it moves forwardly and slightly downwardly where it rests on a second bellows 46. During this same series of movements, the head section has moved so that it rests at its forward edge on an upright support plate 47. Upright support plate 47 is held by the base member 19 and is also supported between the left and right arms 12 and 13 by strap 20. Strap 20 is affixed to the front apron 11 at each end thereof and encircles the sides and back of the convertible sofa mechanism. The convertible sofa mechanism is attached to the sofa arm and back frame by simply being stapled to the left and right arm frames and to the back frame. The unfolding motion is also depicted in FIG. 13 where it can be seen that the head section 31 is supported both by cam follower 29 and the upright support plate 47. After the bellows have been inflated, the middle and foot sections may be manually folded out.

The left side of the mechanism has an analogous bellows, inverted "J-shaped" channel, and the like and functions in the same manner described above. Of course, a single motor 24 can supply all bellows.

Figure 12:
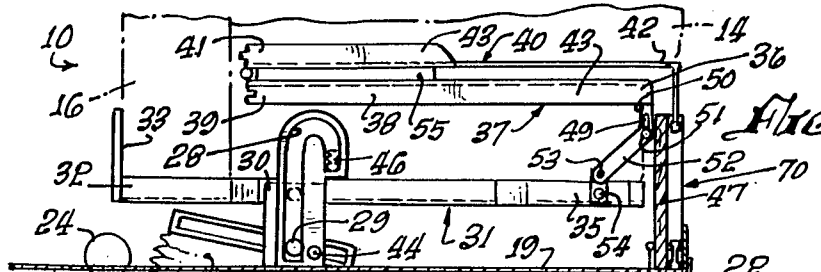
FIG. 12 is a side view of the right side of the convertible sofa mechanism in its sofa configuration.

As shown in FIGS. 12 and 13, middle section 37 is supported above head section 31 by a cushion 48. This provides a beneficial give when one is sitting on the seat cushions 14 or 15 since pressure on seat cushion 14 will also be transmitted through cushion 48 to head section 31 which is supported by cam follower 29. This downward movement, by compression of cushion 48, is further enhanced by the presence of a slot 49 in arm 50 which is welded, or otherwise affixed, to the back edge 36 of the middle section. Slot 49 also holds a pin 51 in arm 52 which, likewise, has a pin 53 which is held by arm 54 affixed near the front edge of head section 31. It can be seen in FIG. 14 in phantom view that as the middle and foot sections are folded out, that arm 50 is moved into an upright position and middle section 37 is aligned with head section 31.

Figure 11:
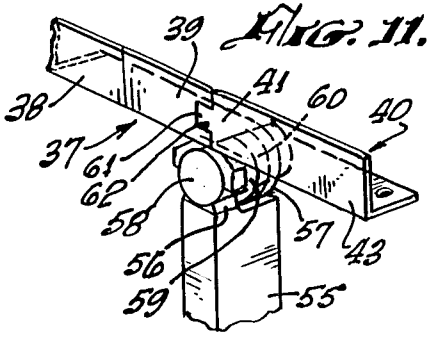
FIG. 11 is an enlarged perspective view of the middle leg of the convertible sofa mechanism of the present invention.

A leg 55 is hingedly affixed at the intersection of the middle section and the foot section and this hinge configuration is shown in enlarged view in FIG. 11. There leg 55 can be seen to have a pair of ears 56 and 57 which hold a pin 58 which, in turn, holds an ear 59 affixed to the middle section and an ear 60 affixed to the foot section. It can also be seen that a tongue 61 on the foot section fits into a groove 62 at the forward edge of the middle section.

A plurality of slats 63 are held to the edges of the frame members by a plurality of springs 64 in a relatively conventional manner. The cushion 48 is slightly narrower than the seat cushions 14 and 15 or the back cushions 16 and 17. This inner cushion 48 remains at the head portion of the bed between the arms of the couch, and its narrow width permits the positioning of the inverted "J-shaped" channel 28 along its side without rubbing.

Figures 5, 6, 7:
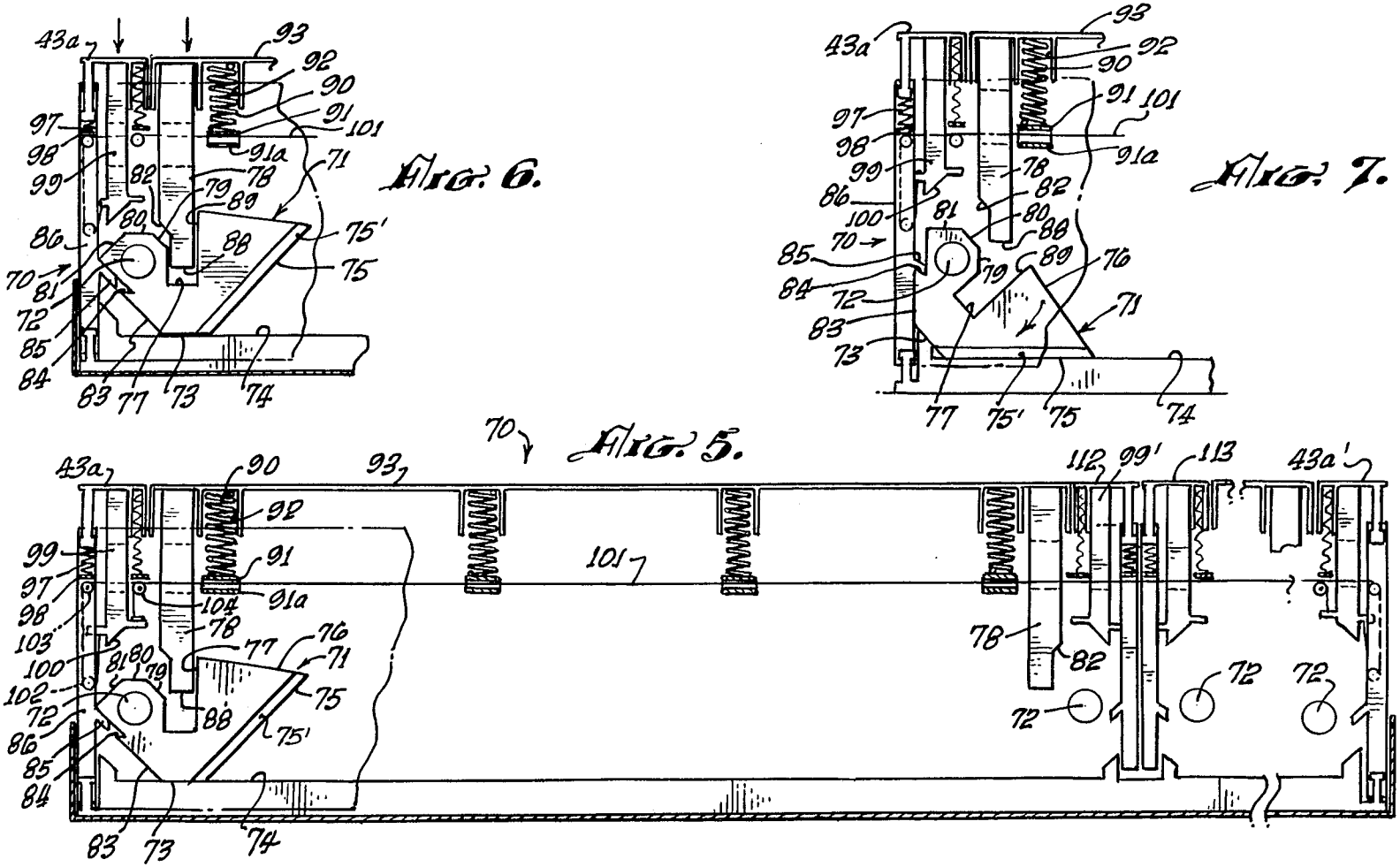
FIG. 5 is a front view, partly in cross-section taken along line 5—5 of FIG. 2.
FIG. 6 is an enlarged view of the right front corner of the convertible sofa mechanism as depicted in its sofa configuration with weight placed on the forward edge.
FIG. 7 is a front view of the right forward edge of the mechanism of the present invention in its unfolded configuration with no weight placed thereon.

Another novel feature of the convertible sofa of the present invention is the method by which the forward edge of either the sofa or the couch is permitted to give in a manner similar to a soft edge couch but not usually possible with a convertible sofa. This downward movement is enabled, both in the contracted position as a convertible sofa and the extended position as a bed, by a novel polygonal member shown in FIGS. 5 through 10. The assembly is held in a subframe indicated generally by reference character 70 which fits adjacent upright support plate 47 when the assembly is in its convertible sofa configuration. Then, as the bellows are inflated, section 70 is lifted upwardly out from behind front apron 11 and forms the forward leg of the bed. First, as shown in FIGS. 5 and 6, the assembly is shown in its couch or folded configuration where it can be seen that polygonal member 71 is in its upper configuration and supported by a pin 72 and also supported by resting its base edge 73 on the floor 74 of subframe 70. Polygonal member 71 also has an angled, inwardly and downwardly-facing side 75 and an angled, inwardly and upwardly-facing side 76. An upwardly-facing slot 77 is shaped to support a support arm 78. Polygonal member 71 has three flat surfaces 79, 80 and 81 which cooperate with surface 82 as is clear from FIGS. 8 and 9. An angled, outwardly and downwardly-facing side 83 has a notch 84 which contacts a pin 85 on an arm 86 Which supports the member 70 in its lower configuration as shown in FIG. 7. Polygonal member 70 may have a weight 75' along side 75.

The function of polygonal member 70 is clear from a comparison of FIGS. 6 and 7 when the mechanism is in its convertible sofa position and the member is in its more upright position. It can be seen that support arm 78 is permitted several inches of movement into the upwardly-facing slot 77 which permits some downward movement of the forward edge of the convertible sofa. If sufficient pressure is provided, the bottom of support arm 78 will contact the base of slot 77. Once the subframe 70 is lifted, the floor 74 drops down an amount such that the lower dumbbell member **85*a* and the upper dumbbell member 86*a* contact the upper and lower ends of channel 87 which extends the height of subframe 70 permitting polygonal member to move downwardly to its position shown in FIG. 7. At this point, the angled, inwardly and downwardly-facing side 75 contacts the floor 74 of the subframe 70, but once again the edge of the bed still may move downwardly as indicated in FIG. 7 where now the bottom surface 88 of support arm 82 will contact inner side 89 of slot 77. Also, surface 82 of support arm 78 will contact surface 80 of the polygonal member 71 and, thus, the downward movement of the forward edge of the bed will be limited. As shown most clearly in FIG. 9, the outermost coil spring 90 is supported by a plate 91 affixed to subframe 70 and at its upper end to a pocket 92 in a forward plate 93. Forward plate 93 is shown in perspective view in FIG. 10. A spring 94 is held on a plate 95 at its lower end and in a pocket 96 located at the front portion 43*a* of right side 43 of the foot section. An outer spring 97 is held on a plate 98 and contacts the lower surface of dumbbell member 86** to permit a downward movement of the right edge of the assembly.

Figures 8, 9, 10:
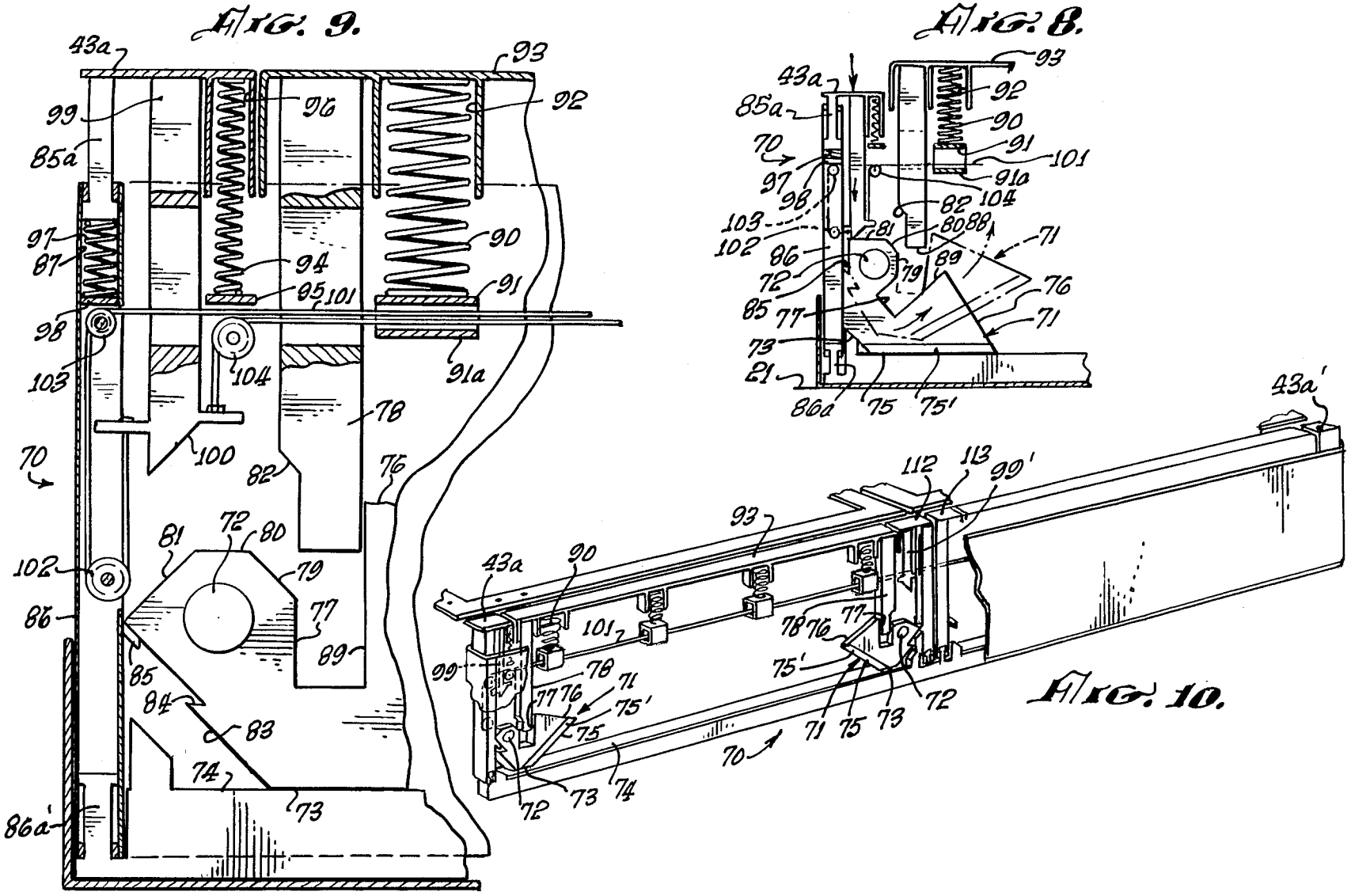
FIG. 8 is a view of the right front corner of the mechanism of the present invention showing the polygonal member pivoted from its bed position to its sofa position.
FIG. 9 is an enlarged front view of the right front corner of the mechanism of the present invention showing the polygonal member in its convertible sofa configuration.
FIG. 10 is a perspective view of a double mechanism configuration of the front portion of the convertible sofa mechanism of the present invention.

When it is desired to reconvert the unit from its bed configuration back to a convertible sofa configuration, a right edge front portion **43*a* is depressed as indicated in FIG. 8, and an actuating arm 99 moves downwardly and its lower cam surface 100 contacts surface 81 of polygonal member 71 moving it upwardly as indicated in FIG. 8. This same motion is transmitted to an analogous actuating arm 99' by a cable 101 which passes through guides 91*a* and over pulleys 102 through 104 and analogous pulleys not shown on the other end of the mechanism. In the event a pair of convertible sofa mechanisms are placed side by side as indicated in FIG. 10 of the drawings, it would be necessary to push down on either the right or left outer front portion 43*a* or 43*a'* together with the front portions 112 and 113**. This returns all polygonal members to an upward position for its sofa configuration.

To return the bed to its convertible sofa configuration, the foot and middle sections are folded back over the cushions 48 and the bed is in a position similar to that shown in FIG. 13. Then kick plate 104 is pushed back which moves arm 105 through link 106, arm 110 moving an inner valve 107 and directing air from tube 111 into tube 108 thereby expanding second bellows 46. This pushes cam follower 29 first upwardly from position 4 to position 3 as shown in phantom lines in FIG. 2 at which point gravity causes bellows 26 to deflate and cam follower 29 moves downward1y along the straight portion of the inverted "J-shaped" channel 28 to its final position as shown in FIG. 2. An important feature of the present invention is the controlled movement of the mechanism from its bed configuration to its convertible sofa configuration. This is brought about by use of the bellows 26. At all times when the device is in its bed configuration, the bellows are in the position indicated by the number 4 in FIG. 2 of the drawings. The straight, sidewardly-facing channel 27 is in a slightly passed the upright orientation and is held in that position by cam follower 29. When the foot and middle sections have been folded back and second bellows 46 has been inflated to the position indicated by number 3 in FIG. 2, the mechanism does not suddenly collapse, but instead is gently lowered by controlling the rate of flow out of bellows 26. This may be accomplished by the use of a three-way valve which in position one directs air from blower motor 24 to bellows 26, in a position two where it directs air from blower motor 24 to second bellows 46 and a third position where air is allowed to escape bellows 26 in a controlled manner. The construction of such three-way valves is conventional and, thus, not shown in detail in the drawings.

Although not shown in the drawings, it is, of course, likely that a fabric apron will cover the subframe 70 for aesthetic reasons. It is also likely that attachment means such as the hook and eye configuration sold under the trademark, "Velcro," will be used to hold the cushions together in their bed configuration.

By the use of polygonal members and the extending subframe, the front support of the convertible sofa assembly automatically converts from its compressed configuration of the convertible sofa position to an extended configuration in its bed mode without the necessity of any action on behalf of the user. Then to reconvert this sub assembly to its convertible sofa position, the user needs only to push downwardly on the edge (and center if two mechanisms are used) and the polygonal members reconvert to their compressed mode for use as a convertible sofa.

Figure 14:
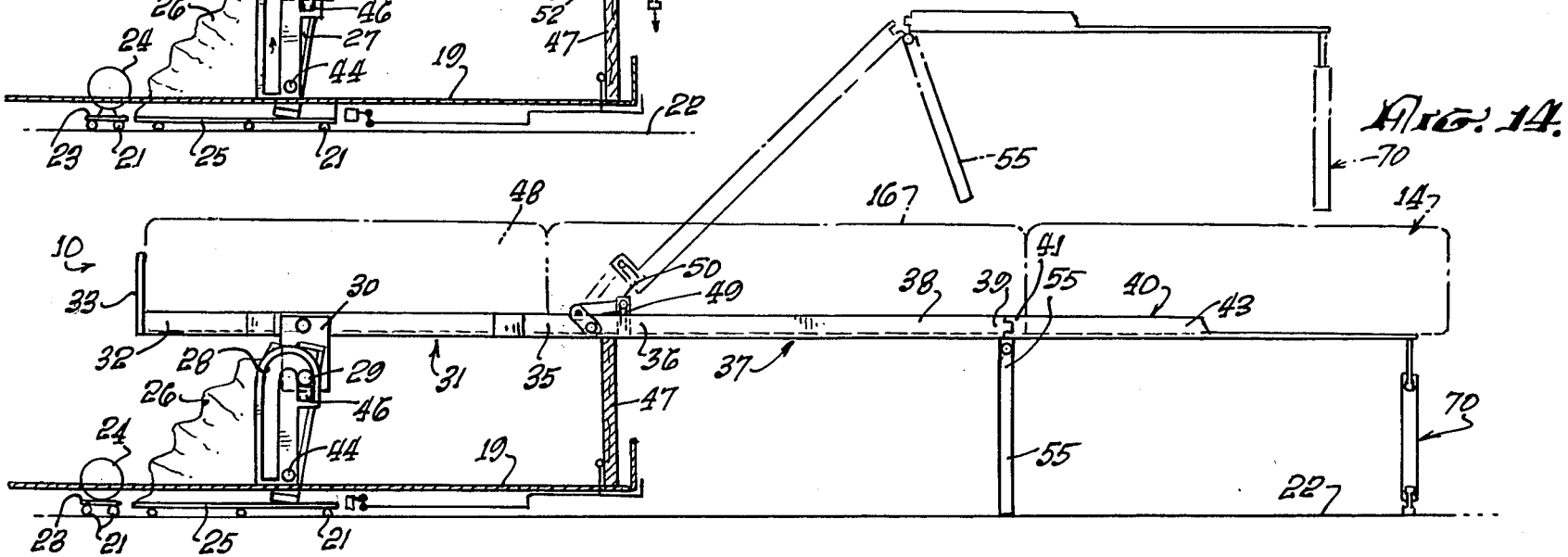
FIG. 14 is a side view of the convertible sofa mechanism showing the next configuration from FIG. 13 as the mechanism is being unfolded into a bed configuration and also shows the completed bed configuration.

As indicated in FIG. 10, a pair of mechanisms can be matched together for a wider couch and bed. It can also be seen that full six-inch thick cushions can and should be used as a mattress as indicated in FIG. 14. There it can be seen that the inner cushion 48 is placed at the head of the mattress, the back cushion 16 can be placed in the middle and the seat cushion 14 can be placed at the foot. A preferred length for the inner cushion is twenty-two and three-fourths inch, twenty-seven inches is preferred for the back cushions and twenty-four inches for the seat cushion providing a total length mattress of seventy-three and three-quarter inches for a bed of adequate length.

The present embodiments of this invention are thus to be considered in all respects a illustrative and not restrictive; the scope of the invention being indicated by the appended claims rather than by the foregoing description. All changes which come within the meaning and range of equivalency of the claims are intended to be embraced therein.

What is claimed is:

1. An improved, three-section convertible sofa mechanism for installation in a convertible sofa and which may be forwardly extended to a full length bed having a head section, a middle section and a foot section, wherein the improvement comprises:

a base member supported on a floor, said base member having a right side, a left side, a front edge and a back edge and having an upwardly extending support along its front edge;

first and second inverted "J-shaped" channels held along the right and left sides of the base member, respectively, and oriented so that the terminus of the "J" is facing the front edge of the base;

first and second main bellows members held by said base and adjacent said first and second inverted "J-shaped" channels, each of said main bellows having a straight sidewardly-facing channel on its upper surface;

a head section held by said base above said base and generally parallel thereto, said head section having a right side, a left side, a front edge and a back edge;

right and left cam follower means affixed to the right and left edges of said head section, each of said cam follower means being captured both by an inverted "J-shaped" channels and by one of the straight, sidewardly-facing channels whereby when said main bellows members are inflated, said cam follower means and their associated head section are carried outwardly along said straight, sidewardly-facing channels and upwardly, outwardly and downwardly along said "J-shaped" channels an extent sufficient to cause the head section to rest near its front edge on the upwardly extending support on said base member;

a middle section having a right side, a left side, a front edge and a back edge, said middle section being hingedly affixed at its back edge to the front edge of said head section and in its folded condition being supported in a parallel manner above the head section, said middle section having leg means affixed along the right and left edges at the back edge thereof; and a foot section having a right side, a left side, a front edge and a back edge, said foot section being hingedly affixed at its back edge to the front edge of said middle section and having leg means affixed along the right and left edges thereof at the front edge thereof, said foot section being moveable between a folded configuration when it is parallel to and above the middle section and to an extended configuration when it is in line with the middle section.

2. The improved, three-section convertible sofa mechanism of claim 1 further including a lower cushion positioned between the head section and middle section when the mechanism is in its folded configuration.

3. The improved, three-section convertible sofa mechanism of claim 2 further including a second cushion positioned above the foot section when the mechanism is in its folded configuration.

4. The improved, three-section convertible sofa mechanism of claim 3 further including a back cushion resting its lower edge near the back edge of the head section.

5. The improved, three-section convertible sofa mechanism of claim 1 further including a pair of second bellows, each of said second bellows being located within said "J-shaped" channel having its lower edge resting on the terminus of the "J-shaped" channel, said second bellows being extendable an amount sufficient to move said right and left cam follower means past the uppermost part of said inverted "J-shaped" channel.

6. The improved, three-section convertible sofa mechanism of claim 1 further including electrically-operated blower motor means having an outlet connected to said main bellows means.

7. The improved, three-section convertible sofa mechanism of claim 5 further including electrically-operated blower motor means having three-way valve means permitting connection either to the main bellows or the second bellows or to a controlled air exit for the main bellows.

8. The improved, three-section convertible sofa mechanism of claim 7 further including switch means located in front of the upwardly extending support of the base member.

9. An improved, three-section convertible sofa mechanism for installation in a convertible sofa and which may be forwardly extended to a full length bed having a head section, a middle section and a foot section, wherein the improvement comprises;

a base member having a right side, a left side, a front edge and a back edge and having an upwardly extending support along its front edge;

a head section held by said base above said base and generally parallel thereto, said head section having a right side, a left side, a front edge and a back edge;

a middle section having a right side, a left side, a front edge and a back edge, said middle section being hingedly affixed at its back edge to the front edge of said head section and in its folded condition being supported in a parallel manner above the head section, said middle section having leg means affixed along the right and left edges at the back edge thereof;

a foot section having a right side, a left side, a front edge and a back edge, said foot section being hingedly affixed at its back edge to the front edge of said middle section and having leg means comprising a subframe having a right and left edge members affixed along the right and left edges thereof at the front edge thereof, said foot section being moveable between a folded configuration when it is parallel to and above the middle section and to an extended configuration when it is in line with the middle section; and a pair of pivotable polygonal members, each being moveable between a folded position and an extended position and having, in its folded position a flat base edge resting on the base member, an angled, inwardly and downwardly-facing edge, and angled, inward and upwardly-facing side, an upwardly-facing slot having an inward edge and an outward edge, a pivot hole positioned near the outward edge of the slot, an angled, outward and upwardly-facing edge, an angled, outwardly and downwardly facing edge, and a pivot pin affixed to said subframe, a support arm affixed to the front edge of the foot section and positioned and shaped so that its lower end fits into the slot of the polygonal member and having a length about several inches above the lower end of the slot when no additional weight is exerted on the front edge of the foot section, biasing means held between said subframe and the front edge of the foot section, each of said polygonal members being positioned adjacent the right and left edges of the subframe so that when the subframe is lifted, the polygonal member pivots downwardly so that its angled, outwardly and downwardly-facing edge rests on the adjacent edge of the subframe and the angled, inwardly and downwardly-facing side rests on the floor and the lower end of the support arm is moveable between a first position about several inches above the outward edge of the slot when no additional weight is exerted on the front edge of the foot section and a second position when it is in contact with the outward edge when additional weight is exerted on the front edge of the foot section, whereby the front edge of the foot section has a biased movement when weight is exerted on it.

10. The improved three-section convertible sofa mechanism of claim 9 further including a pair of control arms held by each edge of the subframe and moveable between an upper, at-rest position when its lower end is above the angled outwardly and upwardly-facing edge and when moved downwardly will contact the angled, outwardly and upwardly-facing edge and move the polygonal member into its folded position.

11. The improved, three-section convertible sofa mechanism of claim 10 wherein there are two identical side-by-side units held by a double width base member.

12. The improved, three-section convertible sofa mechanism of claim 11 further including interconnecting means between the outer control arms so that when one outer control arm is moved downwardly, the other outer control arm moves downwardly but the two adjacent control arms do not move unless separately depressed.

13. The improved, three-section convertible sofa mechanism of claim 9 wherein the subframe has an extendable floor moveable between a folded configuration when it is in a contracted position and an extended configuration when it is in an extended position.

14. The improved, three-section convertible sofa mechanism of claim 13 wherein the extendable floor is held by a pair of dumbbell members affixed at its upper edge to the side edges of the foot section.

* * * * *